US005734118A

United States Patent [19]

Ashour et al.

[11] Patent Number: 5,734,118

[45] Date of Patent: Mar. 31, 1998

[54] MIDI PLAYBACK SYSTEM

[75] Inventors: Gal Ashour, Nesher, Israel; Ronald Jay Lisle, Cedar Park, Tex.; Naftaly Sharir, Haifa, Israel

[73] Assignee: International Business Machines Corporation, Armonk, N.Y.

[21] Appl. No.: 732,360

[22] PCT Filed: Aug. 24, 1995

[86] PCT No.: PCT/GB95/02008

§ 371 Date: Oct. 28, 1996

§ 102(e) Date: Oct. 28, 1996

[87] PCT Pub. No.: WO96/18994

PCT Pub. Date: Jun. 20, 1996

[30] Foreign Application Priority Data

Dec. 13, 1994 [GB] United Kingdom ..... 9425091

[51] Int. Cl.[6] ..... G10H 7/00

[52] U.S. Cl. ..... 84/609; 84/604; 84/623; 84/649

[58] Field of Search ..... 84/604–607, 609, 84/623–625, 649, 622

[56] References Cited

U.S. PATENT DOCUMENTS 5,119,711 6/1992 Bell et al. ..... 84/622

5,300,725 4/1994 Manabe ..... 84/609

*Primary Examiner*—Jonathan Wysocki

*Assistant Examiner*—Marlon Torriano Fletcher

*Attorney, Agent, or Firm*—Volel Emile

[57] ABSTRACT

A MIDI playback system is described in which a sequencer is characterized by: logic for generating a sequence of events, the sequence comprising groups of events, each group comprising events to be executed within a first time interval, the groups being separated in the sequence by marker events for indicating the time intervals, the sequencer being arranged to send the sequence of events together to a synthesizer. A synthesizer is described comprising storage means to receive and store the sequences of events; logic for reading an event from the storage; and logic for determining if the event is a marker event, the synthesizer being arranged to wait, if the event is a marker event, a time equal to the first time interval before reading another event from storage. Using this arrangement, the sequencer is no longer required to schedule the MIDI commands precisely on time and therefore the timing services that a software implementation of such a sequencer might ask from a computer system are reduced.

13 Claims, 3 Drawing Sheets

MIDI PLAYBACK SYSTEM

The invention relates to MIDI (Musical Instrument Digital Interface) playback systems.

TECHNICAL FIELD

MIDI is an internationally recognised specification for data communication between digital electronic musical instruments and other devices, such as computers, lighting controllers, mixers or the like. The MIDI data specifies performance information, as opposed to sound information. For example, which note or notes are being held down, if any additional pressure is applied to the note after being struck, when the key is released and any other adjustments made to the settings of the instrument.

MIDI data is communicated as a serial data stream over cables with standardised connectors at a standard baud rate. The digital data is organised into MIDI 'messages', which contain one MIDI command or event. MIDI commands are usually composed of one, two, or three bytes of data arranged and transmitted one after another. The first byte sent in each command is called the 'status' byte and specifies an operation to be performed. The next one or two bytes, if used, represent parameters of this command. For example, a NOTE ON command comprises three bytes, the first of which is the status byte. This byte tells a synthesizer to play a note and specifies the channel number. The channel number usually represents the type of sound to be played, ie which instrument of the synthesizer is to be used. The second byte specifies the note to be played and the third byte specifies the velocity value for the note.

The bytes of the MIDI commands are specified in the MIDI standard. Part of this standard is a protocol which specifies that the leftmost bit of the status byte is always 1 and in all the following data bytes the leftmost bit is 0. In this way in a stream of MIDI data, the receiving device can always tell, if the leftmost bit in a byte is 1, that the byte is a status byte representing a new command to be processed. By decoding the status byte, the device can tell how many data bytes should follow the status byte.

In a conventional MIDI playback system a synthesizer, which is usually a special piece of hardware for generating sound data from the performance data, usually in the form of digital audio samples, is controlled by a MIDI sequencer in the following way. A standard MIDI file (SMF) contains a set of events, which are intended to be executed by a synthesizer at particular times. Generally, the events are not uniformly spaced in time. A conventional MIDI sequencer parses the standard MIDI file, reads the present MIDI event and the time difference between it and the next event. The sequencer then sends the event in a MIDI message to a MIDI synthesizer at the time it is to be executed. The sequencer usually sets a timer and reads the next MIDI event after this time difference has elapsed.

A conventional MIDI synthesizer receives the MIDI message that the sequencer sends, decodes the message and operates accordingly. For example, a 'NOTE ON' event will cause the synthesizer to generate audio samples that correspond to a requested note and velocity that are supplied as parameters. Similarly, a 'NOTE OFF' event will cause the synthesizer to cease generating the audio samples.

MIDI sequencers for MIDI playback systems usually use timing resolutions of less than 1 mS. This resolution is, to some extent, limited by the fact that baud rate at which MIDI data is communicated is 31,250 bits per second and there are 10 bits of data per MIDI byte (8 data bits+2 bits for error checking). Therefore, MIDI data can only be transmitted at around 3 bytes of data per mS.

However, this resolution is relatively high in comparison with the real time capabilities of currently available computer systems. Therefore, a software implementation of a MIDI sequencer consumes a large amount of host processing power as a result of context switching and high speed interrupts used to perform real time processing at this resolution.

It is known for MIDI sequencers to group events together in various ways into larger time intervals and send the events together to the synthesizer, effectively lowering the temporal resolution. This is known as 'quantizing the MIDI events'. Most commercially available MIDI sequencers provide the ability to quantize MIDI data into larger timing intervals, such as 1/16th note intervals. This feature is provided to enable rhythmic irregularities to be smoothed out and for circumstances in which the sequencer and/or the synthesizer cannot support high time resolution.

Generally, this quantisation is performed 'on the fly' and the MIDI input file is not changed. The sequencer simply groups several events together before sending them at the same time to the synthesizer, despite the fact that there should be time intervals between the events. The fine timing information is lost in this process and the synthesizer is unaware that there should be intervals between the events. This kind of quantization is discussed at pp 651–654 of 'Macworld Sound and Music Bible' by C. Yavelow (IDG Books)

This invention is directed to improving MIDI playback systems so that more efficient use is made of computing resources, without necessarily reducing temporal resolution.

DISCLOSURE OF THE INVENTION

To achieve this, the invention provides a sequencer for use in a MIDI playback system, the sequencer comprising logic for reading events and associated timing information from a stored data file or other source and means for sending the events to a synthesizer for execution; characterised by logic for generating a sequence of events, the sequence comprising groups of events, each group comprising events to be executed within a first time interval, the groups being separated in the sequence by marker events for indicating the time intervals between successive groups of events in the sequence, the sequencer being arranged to send the sequence of events together to a synthesizer.

Therefore, two levels of quantisation are used. The sequencer makes use of conventional quantisation by chaining events together into a sequence, but includes finer resolution timing information in the form of marker events in the data sent to the synthesizer to enable the synthesizer to work at the higher resolution if required.

In a preferred embodiment, the marker events are MIDI System Real Time Messages or MIDI System Exclusive Messages. This has the advantage that the sequencer can be implemented in a manner which is fully compatible with existing synthesizers, which will simply ignore the marker events and work as if the data were quantised at the lower resolution.

Thus, the idea of quantizing MIDI events is generalised by including time information with fine resolution within the sequence of groups. This allows synthesizers to work at high resolution if required without forcing the sequencer to work at the same resolution.

Using this arrangement, the sequencer is no longer required to schedule the MIDI commands precisely on time and therefore the timing services that a software implementation of such a sequencer might ask from a computer system are more moderate. In addition, data transfer overheads are reduced since the sequencer sends sets of groups of events rather than single groups of events. If high resolution output is required then this can be achieved by appropriate logic in the synthesizer, using the marker events interleaved in the sequence of events.

Furthermore, this approach gives the synthesizer the means to produce even higher quality audio than the 1 mS resolution envisaged by the MIDI standard. This can be achieved since in many cases the synthesizer has the capability to control the output sound down to a single digital audio sample, which corresponds to a resolution much higher than 1 mS. As long as the data stored in the data file includes time information to the higher resolution, the use of the technique provided by the invention therefore would allow the effective resolution of MIDI playback systems to be increased.

However, since most users will not be able to perceive a difference in MIDI events occurring at, for instance 5 mS intervals rather than at 1 mS intervals, if high resolution is not required the sequences of events can also be used by a conventional MIDI synthesizer. In which case, the result will sound as if all the events in all the groups within the set had been quantised into a single group.

Accordingly, there is also provided a synthesizer for use with such a sequencer in a MIDI playback system, the synthesizer comprising: storage means to receive and store the sequences of events; logic for reading an event from the storage; and logic for determining if the event is a marker event, the synthesizer being arranged to wait a time equal to the first time interval before reading another event from storage if the event is a marker.

Therefore, the need for operation with high time resolution is shifted from the sequencer to the synthesizer. This is advantageous since synthesizers are generally implemented in specialised hardware. In such an implementation it is much easier to provide such high resolution timing services. Indeed, they may be present in the synthesizer anyway in order to enable the synthesizer to produce audio samples at a high sampling rate. Most sequencers, on the other hand, are implemented in the form of computer programs for use with general purpose computers, such as personal computers. These do not usually provide the required time resolution or, if they do, this comes with a high performance penalty.

In one embodiment, the marker events are spaced uniformly in time. This enables the synthesizer to run at a fixed period or make use of information already present within it, for example by relating the execution of events to the rate at which audio samples are to be produced.

The lengths of the sequences need not be uniform, but could be set dynamically based on the system loading.

In a particular embodiment, the sequencer is in the form of a suitably programmed personal computer and the synthesizer is in the form of a plug-in card for such a computer.

An embodiment of the invention will now be described, by way of example only, with reference to the accompanying drawings, wherein:

BRIEF DESCRIPTION OF THE DRAWINGS

Referring to FIG. 1, a MIDI playback system comprises disk storage device 100 in which is stored MIDI data file, indicated schematically at 110, a sequencer 120 and a synthesizer 130. In this embodiment, sequencer 120 comprises a computer program running in a suitable general purpose personal computer and is arranged to read data file 110 and pass MIDI events in a serial data stream to synthesizer 130.

Synthesizer 130 is in this embodiment assumed to be implemented in hardware as a plug-in sound board for the computer in which the sequencer process is running. However it will be understood that both sequencer 120 and/or synthesizer 130 could, in other embodiments, be implemented as either hardware or software or any combination of the two. For embodiments in which sequencer 120 and/or synthesizer 130 comprise computer programs, these programs might be embodied as articles of manufacture in the form of suitably configured program storage devices, such as magnetic diskettes or CD-ROMs for use with a general purpose computer.

Figure 1:
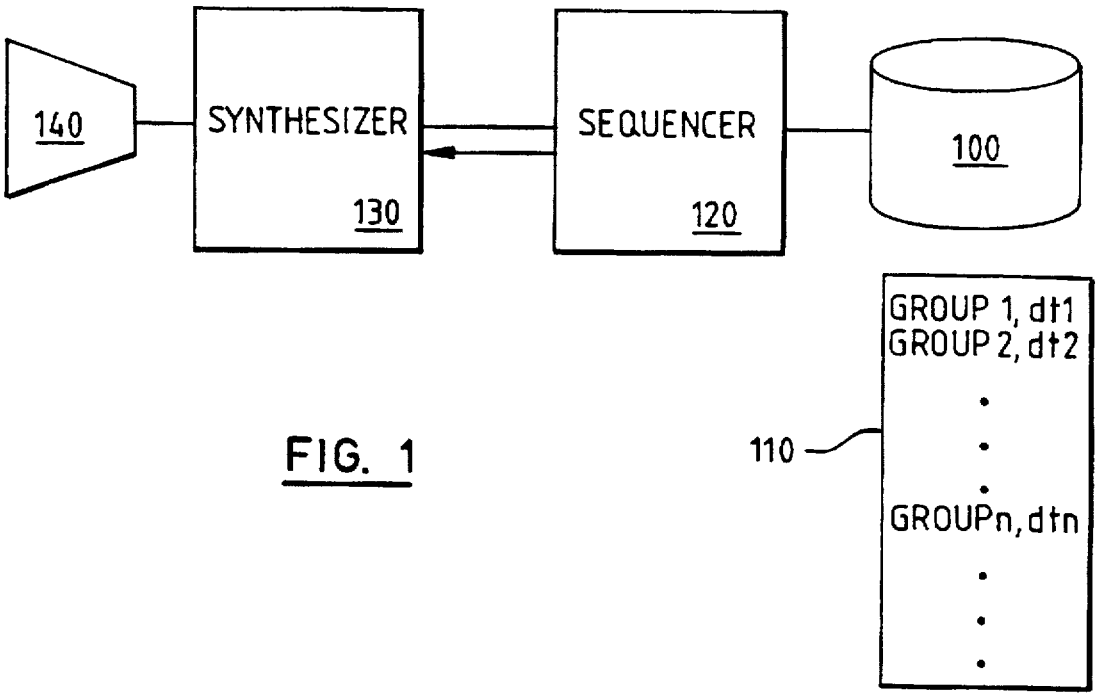
FIG. 1 shows a MIDI playback system.

Synthesizer 130 receives the data stream from the sequencer 120, decodes the MIDI commands and generates output audio samples which are output to a suitable output or recording device indicated generally in FIG. 1 by loudspeaker 140. It will be appreciated that sequencer 120 could also receive MIDI events interactively from a suitable input device such as a MIDI-keyboard.

MIDI events are commands to be carried out by synthesizer 130. Data file 110 stores a sequence of these commands and time information indicating when these commands are to be carried out.

A standard format for MIDI data files has been defined as part of the MIDI framework, although most manufacturers of MIDI sequencers also provide, as an alternative, a native data file format specific to the sequencers of that manufacturer or to the operating system under which the sequencer is designed to run. It will be appreciated that the use of such native formats may provide performance advantages where interchangeability of data files between different sequencers is, for whatever reason, not required for a particular application. The specific format used for the data file is not important for the purposes of this description.

In this embodiment, events are stored as groups of one or more events that are simultaneous in the sense that they are to be executed at the same time. This is illustrated schematically in FIG. 1 by the records GROUPn, dtn where dtn is the time interval between the execution of GROUPn and GROUPn+1. In some data formats, single events within the groups may be separated by dt values of zero.

Figure 2:
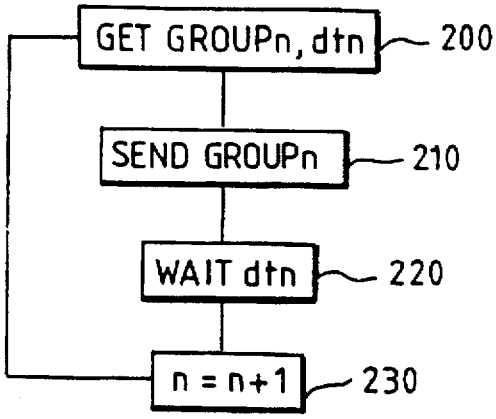
FIG. 2 PRIOR ART
FIG. 2 is a flow diagram illustrating the operation of a conventional MIDI sequencer.

FIG. 2 is a flow diagram illustrating the operation of a conventional MIDI sequencer. The present group of events is read from the file in step 200 along with the time interval to the next event. The group is sent in step 210 to the synthesizer for execution and a timer is set to enable the system to wait in step 220 for the time interval dtn. Once this time has elapsed a group counter is incremented, step 230, and the next group is retrieved and sent to the synthesizer.

Figure 3:
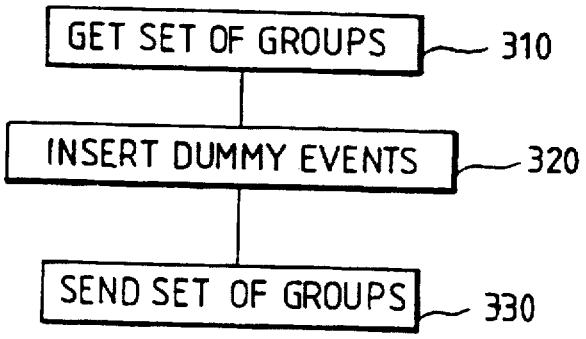
FIGS. 3 and 4 are flow diagrams illustrating the operation of a MIDI sequencer in one embodiment of the invention.

FIG. 3 is a flow diagram illustrating the general operation of a MIDI sequencer in one embodiment of the invention. A plurality of groups of events are retrieved in step 310 from the data file and chained together. The number of groups of events in the set m is determined by a time value $T_1$. $T_1$ would be chosen in accordance with the time resolution available in the sequencer or to optimise system performance. As discussed below, $T_1$ need not be a constant, but could be dynamically controlled by the sequencer in accordance with the computing resources available at any particular time. $T_1$ could, for example, be of the order of 5 mS.

Dummy MIDI events are inserted in step 320 to separate groups of events occurring at different times. The dummy events are data which have the structure of MIDI events, but which do not correspond to any specific command within the MIDI framework because these byte values are left undefined in the MIDI specification. These dummy events serve as markers to separate groups of events which should occur at intervals defined by a value $T_2$ which is less than $T_1$. $T_2$ could, for example, represent the normal MIDI resolution of 1 mS or could be lower than this to enable the sythesizer to support a resolution higher than the 1 mS MIDI resolution.

The set of groups is then sent in step 330 to a first in first out (FIFO) buffer in the synthesizer.

There are two main types of MIDI messages, called channel messages and system messages. System messages do not include a channel number. There are three types of system messages, called System Exclusive Messages, System Common Messages and System Real Time Messages.

System Real Time Messages consist of a single status byte with no data bytes and are generally used to synchronise two devices. Some system real time messages are undefined and, in this embodiment, one of these undefined events is used as the dummy event.

The MIDI framework provides for events which permit different manufacturers to expand the MIDI spec to include commands which are only understood by their own devices. These are known as 'System Exclusive Messages'. Each manufacturer is assigned an individual ID number that identifies the manufacturer. A SysEx status byte is sent indicating that system exclusive data is to follow. The first data byte of the command is the manufacturer's ID. Devices not designed to be compatible with those of the manufacturer identified by this first data byte will simply ignore the rest of the data until an End of Exclusive EOX message is received. Such system exclusive events could also be used as markers.

The use of System Real Time Messages or System Exclusive Messages for the markers ensures that the sequencer is fully compatible with conventional MIDI sythesizers.

Figure 4:
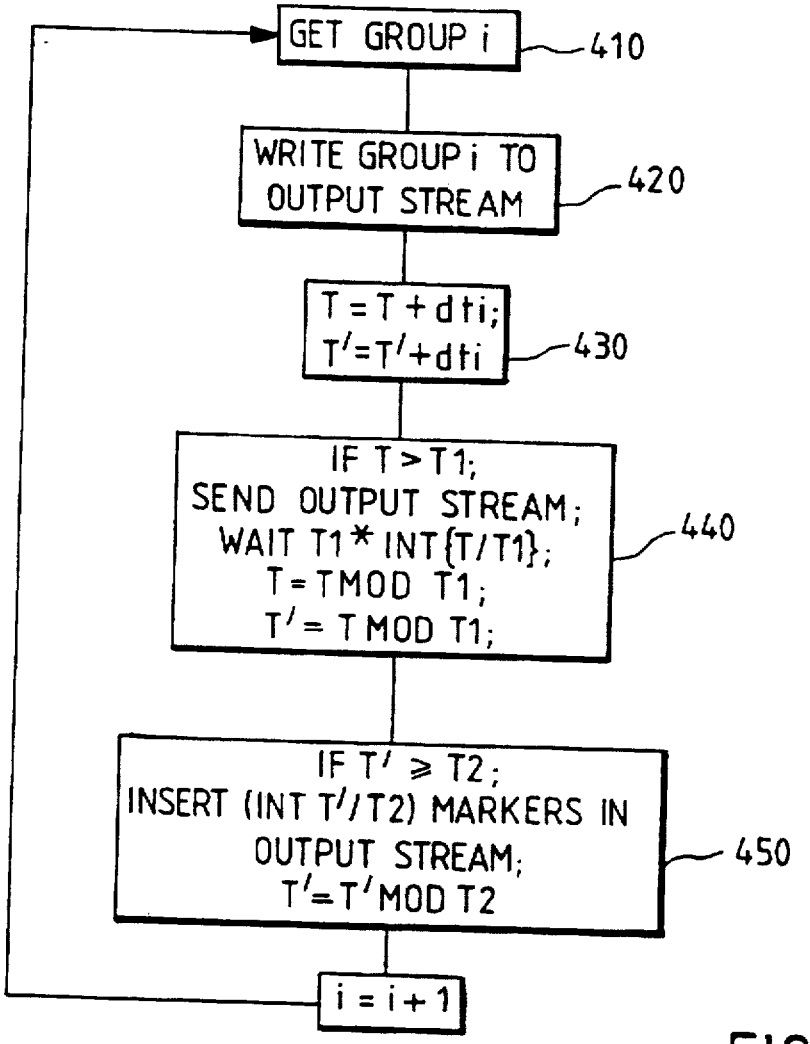

The process of FIG. 3 is illustrated in more detail in FIG. 4. The groups are read in sequence in step 410. A current group is appended to the output stream in step 420 and variables T and T' are incremented in step 430 with the differential time value dti associated with group i. T is compared with $T_1$ in step 440. If T is greater than $T_1$ the output stream is sent to the synthesiser and the sequencer waits for a time $T_1$ $INT(T/T_1)$. The variables T and T' are set to T $MOD(T_1)$. T' is then compared with $T_2$ in step 450. If T' is greater than $T_2$ one or more markers are appended to the output stream. The number of markers appended is equal to $INT(T/T_2)$. T' is then set to $T'MOD(T_2)$. A counter i is incremented and the process is repeated for the next group.

It will be appreciated that, if SysEx messages are used as the marker events, these might carry data indicating the time delay between two successive events in the set of groups. This would obviate the need to have more then one marker next to each other in the output stream to indicate a time delay greater than $T_2$ between two successive events in the set of groups.

Figure 5:
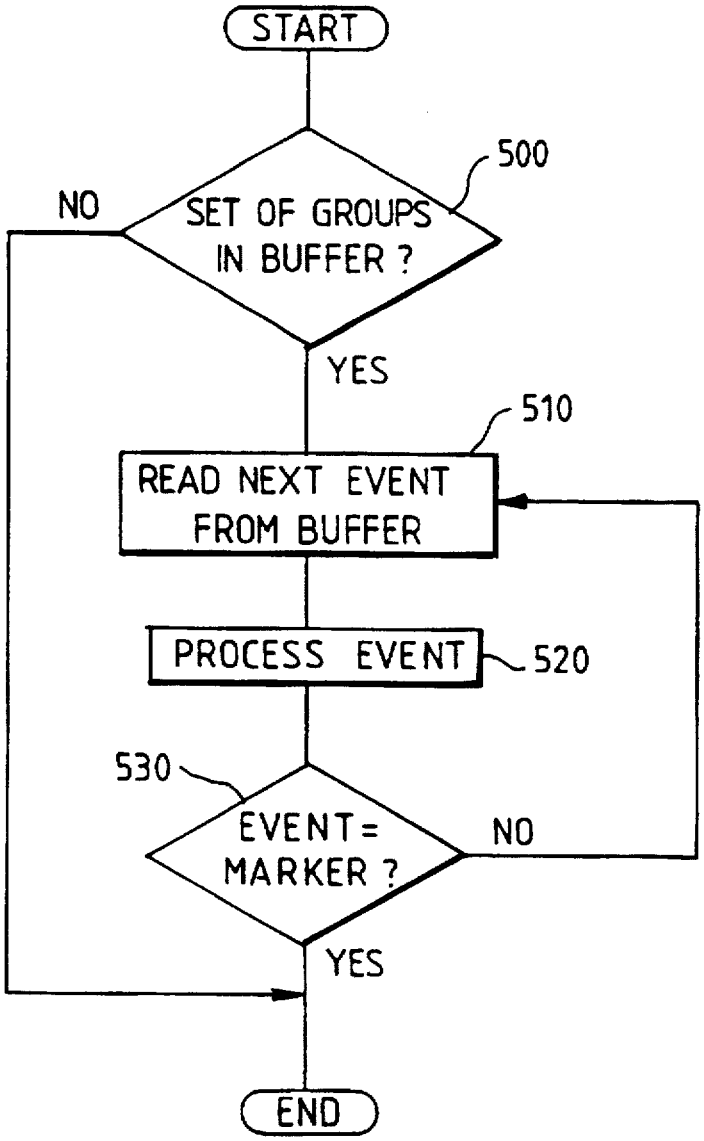
FIG. 5 is a flow diagram illustrating the operation of a MIDI synthesizer.

FIG. 5 is a flow diagram illustrating the operation of synthesizer 130 in one embodiment of the invention. The synthesizer task is triggered periodically at time intervals $T_2$ equal to the spacing in time of the groups of events separated by the markers. Each time the synthesizer is triggered it is determined in step 500 whether there are any events to be processed in the buffer. If so, a single group of events is read from the buffer in step 510 and decoded and processed in step 520. It is determined whether the event is a marker in step 530. If so, the process ends until next triggered a time $T_2$ later. In other words, if the event is a marker the synthesizer internal settings are not changed and the synthesizer will continue in its existing operating state.

If the event is not a marker, the event is acted upon by the synthesizer in the normal way and a further event or group of events is read from the buffer and processed in the same way. This process is repeated until a marker is detected.

It will be understood that this arrangement inevitably gives rise to a delay between input events from the file or keyboard and the sound output. The number of groups of events chained together, determined in this embodiment by the time $T_1$, can be designed to optimise performance of the system according to desired requirements and the capabilities of the synthesizer and sequencer. In more complex embodiments it would be possible for the sequencer to monitor the available computing resources and dynamically set the length, in time, of the set of groups accordingly.

What is claimed is:

1. A sequencer for use in a MIDI playback system, the sequencer comprising:

logic for reading events and associated timing information from a stored data file or other source and means for sending the events to a synthesizer for execution;

logic for generating a sequence of events, the sequence comprising groups of events, the groups being separated in the sequence by marker events for indicating a first time interval ($T_2$) between successive groups in the sequence, the sequencer being arranged to send the sequence of events together to a synthesizer said synthesizer including:

storage means to receive and store the sequences of events;

logic for reading an event from the storage means; and logic for determining if the event is a marker event, the synthesizer being arranged to wait, if the event is a marker event, a time equal to the first time interval ($T_2$) before reading another event from the storage means.

2. A synthesizer as claimed in claim 1 wherein the storage means is a first in first out buffer.

3. A synthesizer as claimed in claim 1 comprising means for triggering the reading logic and the determining logic periodically with a time period equal to the first time interval ($T_2$).

4. A synthesizer as claimed in claim 1 in the form of a plug-in card for a personal computer.

5. A sequencer for use in a MIDI playback system comprising:

logic means for reading events and associated timing information from a stored data file or other source;

means for gathering said events into groups; and means for transmitting a plurality of said groups to a synthesizer for execution, said groups in each of said transmitted plurality of groups being separated from each other by a marker event indicating a time by which a corresponding group is to be executed.

6. A sequencer as claimed in claim 5 in which the marker event is a MIDI System Real Time Message or a MIDI System Exclusive Message.

7. The sequencer of claim 5 wherein each plurality of said transmitted groups contains a number of groups determined by a time interval $T_1$, said time interval $T_1$ being the time interval at which each plurality of groups is transmitted.

8. A method of using a sequencer in a MIDI playback system comprising the steps of:

reading events and associated timing information from a stored data file or other source;

gathering said events into groups; and transmitting a plurality of said groups to a synthesizer for execution, said groups in each of said transmitted plurality of groups being separated from each other by a marker event indicating a time by which a corresponding group is to be executed.

9. The method of claim 8 in which the marker event is a MIDI System Real Time Message or a MIDI System Exclusive Message.

10. The method of claim 8 wherein each plurality of said transmitted groups contains a number of groups determined by a time interval $T_1$, said time interval $T_1$ being the time interval at which each plurality of groups is transmitted.

11. A computer program product, stored on a computer readable medium and executable by a processor, for use in a MIDI playback system comprising:

logic means for reading events and associated timing information from a stored data file or other source;

means for gathering said events into groups; and means for transmitting a plurality of said groups to a synthesizer for execution, said groups in each of said transmitted plurality of groups being separated from each other by a marker event indicating a time by which a corresponding group is to be executed.

12. The computer program product of claim 11 in which the marker event is a MIDI System Real Time Message or a MIDI System Exclusive Message.

13. The computer program product of claim 11 wherein each plurality of said transmitted groups contains a number of groups determined by a time interval $T_1$, said time interval $T_1$ being the time interval at which each plurality of groups is transmitted.

* * * * *